US011111803B2

(12) United States Patent
Jung et al.

(10) Patent No.: US 11,111,803 B2
(45) Date of Patent: Sep. 7, 2021

(54) SEALING STRUCTURE BETWEEN TURBINE ROTOR DISK AND INTERSTAGE DISK

(71) Applicant: DOOSAN HEAVY INDUSTRIES & CONSTRUCTION CO., LTD., Changwon-si (KR)

(72) Inventors: Sung Chul Jung, Daejeon (KR); Victor Shemyatovskiy, Changwon-si (KR)

( * ) Notice: Subject to any disclaimer, the term of this patent is extended or adjusted under 35 U.S.C. 154(b) by 0 days.

(21) Appl. No.: 15/931,812

(22) Filed: May 14, 2020

(65) Prior Publication Data

US 2020/0386110 A1 Dec. 10, 2020

(30) Foreign Application Priority Data

Jun. 5, 2019 (KR) ..... 10-2019-0066762

(51) Int. Cl.
*F01D 11/00* (2006.01)
*F01D 5/30* (2006.01)

(52) U.S. Cl.
CPC ..... *F01D 11/006* (2013.01); *F01D 5/3015* (2013.01); *F01D 11/001* (2013.01); *F05D 2230/64* (2013.01); *F05D 2240/20* (2013.01); *F05D 2240/55* (2013.01); *F05D 2240/80* (2013.01); *F05D 2260/30* (2013.01)

(58) Field of Classification Search
CPC .... F01D 11/001; F01D 11/005; F01D 11/006; F01D 5/3015
See application file for complete search history.

(56) References Cited

U.S. PATENT DOCUMENTS 4,484,858 A * 11/1984 Kurosawa ..... F01D 11/005 416/193 A
5,236,302 A 8/1993 Weisgerber et al.
5,320,488 A 6/1994 Meade et al.
5,445,499 A 8/1995 Charbonnel
(Continued)

FOREIGN PATENT DOCUMENTS

JP 2002061518 A 2/2002
JP 2002201915 A 7/2002
KR 10-0750415 B1 8/2007

*Primary Examiner* — David Hamaoui
*Assistant Examiner* — Michael K. Reitz
(74) *Attorney, Agent, or Firm* — Harvest IP Law, LLP

(57) ABSTRACT

A sealing structure for a gas turbine includes a turbine rotor disk, a turbine blade coupled the turbine rotor disk, and an interstage disk interposed between adjacent turbine rotor disks. The turbine blade includes a blade circumferential surface protruding axially and extending in a circumferential direction of the turbine rotor disk and mutually engaging with a disk circumferential surface formed circumferentially on the turbine rotor disk. The interstage disk includes a rim portion and a groove formed in the rim portion. A plurality of static ring seals are mounted in the groove, each static ring seal facing toward the blade circumferential surface and the disk circumferential surface. The static ring are configured such that an outer circumferential surface of all the static ring seals contact the blade circumferential surface and the outer circumferential surface of at least one of the static ring seals does not contact the disk circumferential surface.

13 Claims, 11 Drawing Sheets

(56) References Cited

U.S. PATENT DOCUMENTS

| | | | | |
|---|---|---|---|---|
| 6,464,453 | B2 * | 10/2002 | Toborg | F01D 5/081 415/115 |
| 6,655,920 | B2 * | 12/2003 | Beutin | F01D 11/02 416/198 A |
| 7,052,240 | B2 * | 5/2006 | Race | F01D 5/3015 416/198 A |
| 7,520,718 | B2 | 4/2009 | Engle | |
| 8,221,062 | B2 | 7/2012 | Liotta et al. | |
| 9,399,926 | B2 | 7/2016 | Wiebe | |
| 2015/0010393 | A1 * | 1/2015 | Hafner | F01D 11/001 415/173.7 |
| 2016/0237840 | A1 * | 8/2016 | Leduc | F01D 11/006 |

* cited by examiner

SEALING STRUCTURE BETWEEN TURBINE ROTOR DISK AND INTERSTAGE DISK

CROSS REFERENCE TO RELATED APPLICATION

The present application claims priority to Korean Patent Application No. 10-2019-0066762, filed on Jun. 5, 2019, the entire contents of which are incorporated herein for all purposes by this reference.

BACKGROUND OF THE DISCLOSURE

Field

The present disclosure relates to a sealing structure between a turbine rotor disk provided in a turbine section of a gas turbine and an interstage disk disposed between the turbine rotor disks.

Discussion of Related Art

The turbine is a mechanical device that obtains a rotational force by an impact force or reaction force using a flow of a compressible fluid such as steam or gas. The turbine includes a steam turbine using a steam and a gas turbine using a high temperature combustion gas. Among these, the gas turbine is mainly composed of a compressor, a combustor, and a turbine.

The compressor of a gas turbine is provided with an air inlet for introducing air, and a plurality of compressor vanes and compressor blades, which are alternately arranged in a compressor casing. The air introduced from outside is gradually compressed through the rotary compressor blades disposed in multiple stages up to a target pressure. The combustor supplies fuel to the compressed air compressed in the compressor and ignites a fuel-air mixture with a burner to produce a high temperature and high pressure combustion gas. The turbine has a plurality of turbine vanes and turbine blades disposed alternately in a turbine casing.

Further, a rotor is arranged in the gas turbine to pass through the centers of the compressor, the combustor, the turbine, and an exhaust chamber. Both ends of the rotor are rotatably supported by bearings. A plurality of disks is fixed to the rotor so that the respective blades are connected, and a drive shaft is connected to an end of the exhaust chamber to drive a generator or similar apparatus.

Gas turbines have no reciprocating mechanism such as a piston in a four-stroke engine, so that there are no mutual frictional parts like piston-cylinder. Thus, gas turbines have advantages in that consumption of lubricating oil is extremely small, amplitude as a characteristic of a reciprocating machine is greatly reduced, and high speed operation is possible.

In the operation of a gas turbine, the compressed air in the compressor is mixed with fuel and combusted to produce a high-temperature combustion gas, which is then injected toward the turbine. The injected combustion gas passes through the turbine vanes and the turbine blades to generate a rotational force, which causes the rotor to rotate. The turbine blades are radially coupled along the circumferential surfaces of the turbine rotor disks in a dovetail manner or the like to convert a flow of combustion gas into a rotational motion.

A plurality of turbine rotor disks constituting one turbine stage are spaced apart along the axial direction to form a multi-stage gas turbine, and interstage disks are disposed between the turbine rotor disks to form an internal cooling channel along with the turbine rotor disks. In addition, several static ring seals are mounted in grooves provided in a rim portion of the interstage disk in order to prevent leakage of cooling air at a point between a platform and a root of the turbine blade.

Since the static ring seal mounted on the interstage disk contacts a circumferential surface of the rotating turbine blade and wears out over time, the static ring seal needs to be replaced periodically. According to known configurations, the static ring seal is obscured by the blade circumferential surface and a disk circumferential surface so that the static ring seal was inaccessible from the outside. That is, such a static ring seal can only be replaced by removing the corresponding turbine rotor disk, and in order to replace an entire set of static ring seals, it is necessary to remove both the turbine rotor disk and the interstage disk. Therefore, the replacement and maintenance of the static ring seals has required considerable time and effort.

In addition, considering the assembly and thermal expansion, a slight gap is provided between the circumferential surfaces of the blade and the disk, so that there is a high risk of leakage of cooling gas through the gap. There is also a disadvantage that it is easy to promote wear due to strong stress applied on the static ring seal because the rim portion of the interstage disk should be extended to a point between the platform and the root of the turbine blade.

SUMMARY OF THE DISCLOSURE

Accordingly, the present invention has been made keeping in mind the above problems occurring in the related art, an objective of the present disclosure is to enable the replacement of entire static ring seals mounted on an interstage disk without removing a turbine rotor disk and the interstage disk.

Another objective of the present disclosure is to provide a novel sealing structure capable of reducing a cooling air leaking through a gap between a turbine blade and a turbine rotor disk, and further mitigating stress applied to a static ring seal.

In an aspect of the present disclosure, there is provided a sealing structure for a gas turbine including a plurality of turbine rotor disks. The sealing structure may include a turbine rotor disk of the plurality turbine rotor disks; a turbine blade fastened to a coupling slot formed in a circumferential surface of the turbine rotor disk, and an interstage disk. The turbine blade may include a root having a shape corresponding to the coupling slot, a platform positioned radially outward from the root part, a blade extending from the platform part, and a blade circumferential surface that is formed on a radially inner side of the platform and protrudes in an axial direction, the blade circumferential surface extending in a circumferential direction of the turbine rotor disk and mutually engaging with a disk circumferential surface formed circumferentially on the turbine rotor disk. The interstage disk may be interposed between adjacent turbine rotor disks of the plurality of turbine rotor disks, the interstage disk including a rim portion extending radially outward and a groove formed in the rim portion. A plurality of static ring seals may be mounted in the groove of the interstage disk, each static ring seal having an outer circumferential surface facing toward the blade circumferential surface and the disk circumferential surface, the plurality of static ring configured such that the outer circumferential surface of all of the plurality of static ring seals contact the blade circumferential surface and such that the outer circumferential surface of at least one of the plurality of static ring seals does not contact the disk circumferential surface.

The plurality of static ring seals may be arranged in the axial direction from the turbine blade and include an outermost static ring seal with respect to the turbine blade, and the at least one of the plurality of static ring seals that does not contact the disk circumferential surface may include the outermost static ring seal. Each static ring seal may consist of a plurality of ring segments. Each of the plurality of ring segments may include a separation hole, and the rim portion of the interstage disk may include a radially outer edge in which a separation slot is formed and configured to expose the separation hole of a ring segment of the outermost static ring seal. The plurality of ring segments of one of the plurality of static ring seals may be mounted to be staggered in the axial direction with respect to the plurality of ring segments of an adjacent static ring seal of the plurality of static ring seals, and the separation slots may include at least two separation slots configured to expose the separating holes of the staggered ring segments.

Each of the plurality of ring segments may include a radially inner edge in which an anti-rotation slot is formed, and the anti-rotation slot may receive an anti-rotation pin provided in the groove. The plurality of ring segments of one of the plurality of static ring seals may be mounted to be staggered with respect to the plurality of ring segments of an adjacent static ring seal of the plurality of static ring seals, and the anti-rotation slots of the plurality of ring segments may be respectively formed at positions where the anti-rotation pin is received simultaneously by the anti-rotation slots of the plurality of ring segments.

The plurality of static ring seals may be arranged in the axial direction from the turbine blade and include an outermost static ring seal with respect to the turbine blade; each of the plurality of static ring seals may have an equal thickness in the axial direction; and the disk circumferential surface may not be in contact with only the outermost static ring seal.

The rim portion of the interstage disk may include an opposing pair of rim portions respectively extending in opposite directions toward each of the adjacent turbine rotor disks, and the blade circumferential surface and the disk circumferential surface may be formed on opposite sides of the interstage disk.

The blade circumferential surface may be formed such that a radially outer portion of the root protrudes in the axial direction. The blade circumferential surface may include a curved surface respectively formed on axially opposite sides of the turbine blade. The disk circumferential surface may include a curved surface respectively formed on axially opposite sides of the turbine rotor disk, and the curved surface of the disk circumferential surface may correspond to the curved surface of the blade circumferential surface, such that the curved surfaces of the disk circumferential surface and the blade circumferential surface are mutually engaged with each other.

The plurality of ring segments of one of the plurality of static ring seals may be mounted to be staggered in the axial direction with respect to the plurality of ring segments of an adjacent static ring seal of the plurality of static ring seals; Each of the staggered ring segments may include a separation hole and a radially inner edge in which an anti-rotation slot is formed; the rim portion of the interstage disk may include a radially outer edge in which at least two separation slots are formed and configured to expose corresponding separation holes of the staggered ring segments; and the groove may be provided with a single anti-rotation pin configured to be simultaneously captured by the anti-rotation slots of the staggered ring segments.

In another aspect of the present disclosure, there is provided a method of replacing the plurality of static ring seals in a sealing structure for a gas turbine including a plurality of turbine rotor disks and an interstage disk interposed between adjacent turbine rotor disks of the plurality of turbine rotor disks. The method may include firstly separating a turbine blade from a turbine rotor disk of the plurality of turbine rotor disks; secondly separating, after the firstly separating, a ring segment of an outermost static ring seal of the plurality of static ring seals arranged in an axial direction from the turbine blade, the outermost static ring seal disposed farthest from the turbine blade and exposed in a radial direction; and thirdly separating, after the secondly separating, a ring segment of a next-outermost static ring seal of the plurality of static ring seals that is accessible by being exposed in the radial direction.

The method may further include repeating the thirdly separating until all of the plurality of static ring seals are separated.

The separation of the ring segments of the secondly separating and the thirdly separating may be performed by accessing a separation hole formed in each ring segment through a separation slot formed in a radially outer edge of a rim portion of the interstage disk.

The method may further include sequentially installing ring segments of another static ring seal in a groove formed in the interstage disk, from which the plurality of static ring seals have been removed, by performing the firstly separating, the secondly separating, and the thirdly separating in reverse order.

The method may further include, after the secondly separating, axially shifting all of the plurality of static ring seals in a groove formed in the interstage disk, the axially shifted static ring seals excluding the outermost static ring seal.

According to the above-described configuration of the sealing structure between the turbine rotor disk and the interstage disk, the blade circumferential surface contacts all of the plurality of static ring seals, while the disk circumferential surface does not contact at least one of the plurality of static ring seals which is disposed on the outermost side with respect to the turbine blade, thereby enabling all of the static ring seals mounted on the interstage disk to be replaced with only the turbine blade removed.

In addition, since the blade circumferential surface and the disk circumferential surface are tightly coupled to each other while constituting a part of the fir-shaped curved surface, there is almost no gap between the blade circumferential surface and the disk circumferential surface, thereby having the advantage of greatly reducing the risk of leakage of cooling gases over the related art.

In addition, as the blade circumferential surface and the disk circumferential surface constitute a part of the fir-shaped curved surface, the rim portion of the interstage disk need only be extended up to an upper portion of the root of the turbine blade. Thus, the diameter of the interstage disk can be reduced compared to contemporary interstage disks so that the diameter of the static ring seal can be reduced accordingly, thereby advantageously mitigating the stress applied to the static ring seal.

DETAILED DESCRIPTION OF THE DISCLOSURE

Figure 1:
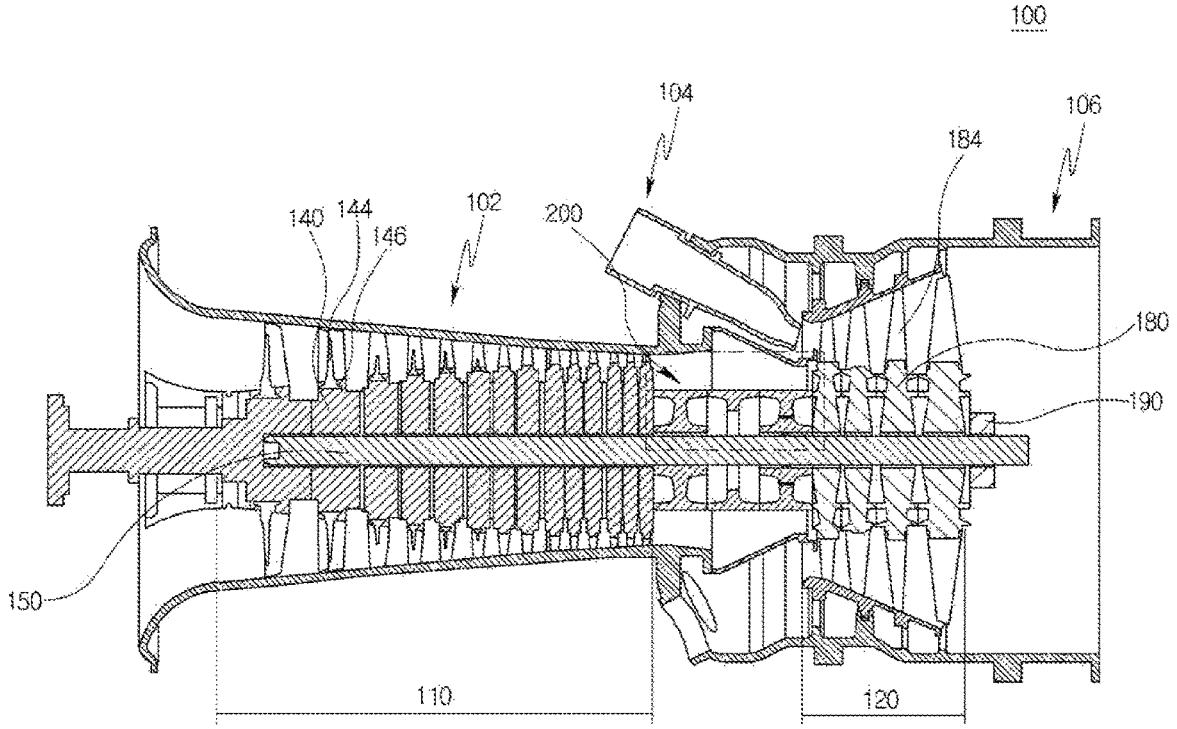
FIG. 1 is a sectional view of a gas turbine to which may be applied a sealing structure of an embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the term "comprising" or "including" specifies the presence of stated feature, number, step, operation, element, part, or combination thereof, but does not preclude the presence or addition of one or more other features, numbers, steps, operations, elements, parts, or combinations thereof.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

FIG. 1 illustrates an example of a gas turbine 100 to which an embodiment of the present invention is applied. The gas turbine 100 includes a housing 102 and a diffuser 106 which is disposed on a rear side of the housing 102 and through which a combustion gas passing through a turbine is discharged. A combustor 104 is disposed in front of the diffuser 106 so as to receive and burn compressed air.

Referring to the flow direction of the air, a compressor section 110 is located on the upstream side of the housing 102, and a turbine section 120 is located on the downstream side of the housing. A torque tube 130 is disposed as a torque transmission member between the compressor section 110 and the turbine section 120 to transmit the rotational torque generated in the turbine section to the compressor section.

The compressor section 110 is provided with a plurality (for example, fourteen) of compressor rotor disks 140, which are fastened by a tie rod 150 to prevent their axial separation.

Specifically, the compressor rotor disks 140 are axially arranged with the tie rod 150 passing through their substantially central portions. Here, the neighboring compressor rotor disks 140 are disposed so that their opposing surfaces are pressed together by the tie rod 150 and so that the neighboring compressor rotor disks do not rotate relative to each other.

A plurality of blades 144 are radially coupled to an outer circumferential surface of the compressor rotor disk 140. Each of the blades 144 has a root portion 146 which is fastened to the compressor rotor disk 140.

Vanes (not shown) fixed to the housing are respectively positioned between the rotor disks 140. Unlike the rotor disks, the vanes are fixed to the housing and do not rotate. The vane serves to align a flow of compressed air that has passed through the blades of the compressor rotor disk and guide the air to the blades of the rotor disk located on the downstream side.

The fastening method of the root portion 146 includes a tangential type and an axial type. These may be chosen according to the required structure of the commercial gas turbine, and may have a generally known dovetail or fir-tree shape. In some cases, it is possible to fasten the blades to the rotor disk by using other fasteners such as keys or bolts in addition to the fastening shape.

The tie rod 150 is arranged to pass through the center of the compressor rotor disks 140. One end of the tie rod 150 is fastened in the compressor rotor disk located on the farthest upstream side, and the other end is fastened in the torque tube 130.

The shape of the tie rod 150 is not limited to that shown in FIG. 1, but may have a variety of structures depending on the gas turbine. That is, one tie rod may have a shape passing through a central portion of the rotor disk as shown in the drawing, or a plurality of tie rods may be arranged in a circumferential manner. A combination of these configurations may also be used.

Although not shown, the compressor of the gas turbine may be provided with a vane serving as a guide element at the next position of the diffuser in order to adjust a flow angle of a pressurized fluid entering a combustor inlet to a designed flow angle. The vane is referred to as a deswirler.

The combustor 104 mixes the introduced compressed air with fuel and combusts the air-fuel mixture to produce a high-temperature and high-temperature and high-pressure combustion gas. With an isobaric combustion process in the compressor, the temperature of the combustion gas is increased to the heat resistance limit that the combustor and the turbine components can withstand.

The combustor consists of a plurality of combustors, which are arranged in the casing formed in a cell configuration. Each cell includes a burner having a fuel injection nozzle and the like, a combustor liner forming a combustion chamber, and a transition piece as a connection between the combustor and the turbine.

Specifically, the combustor liner provides a combustion space in which the fuel injected by the fuel nozzle is mixed with the compressed air of the compressor and the fuel-air mixture is combusted. Such a liner may include a flame canister providing a combustion space in which the fuel-air mixture is combusted, and a flow sleeve forming an annular space surrounding the flame canister. A fuel nozzle is coupled to the front end of the liner, and an igniter is coupled to the side wall of the liner.

On the other hand, a transition piece is connected to a rear end of the liner so as to transmit the combustion gas to the turbine side. An outer wall of the transition piece is cooled by the compressed air supplied from the compressor so as to prevent thermal breakage due to the high temperature combustion gas. To this end, the transition piece is provided with cooling holes through which compressed air is injected into and cools the inside of the transition piece and flows towards the liner. The air that has cooled the transition piece flows into the annular space of the liner and compressed air is supplied as a cooling air to the outer wall of the liner from the outside of the flow sleeve through cooling holes provided in the flow sleeve so that both air flows may collide with each other.

The high-temperature and high-pressure combustion gas from the combustor is supplied to the turbine section 120. The supplied high-temperature and high-pressure combustion gas expands and collides with and provides a reaction force to rotating blades of the turbine to cause a rotational torque, which is then transmitted to the compressor section through the torque tube. Here, an excess of the power required to drive the compressor is used to drive a generator or the like.

The turbine section is basically similar in structure to the compressor section. That is, the turbine section 120 is also provided with a plurality of turbine rotor disks 180 similar to the compressor rotor disks of the compressor section. Thus, the turbine rotor disk 180 also includes a plurality of turbine blades 184 disposed radially. The turbine blade 184 may also be coupled to the turbine rotor disk 180 in a dovetail coupling manner, for example. Between the blades 184 of the turbine rotor disk 180, a vane (not shown) fixed to the housing is provided to induce a flow direction of the combustion gas passing through the blades.

Figure 2:
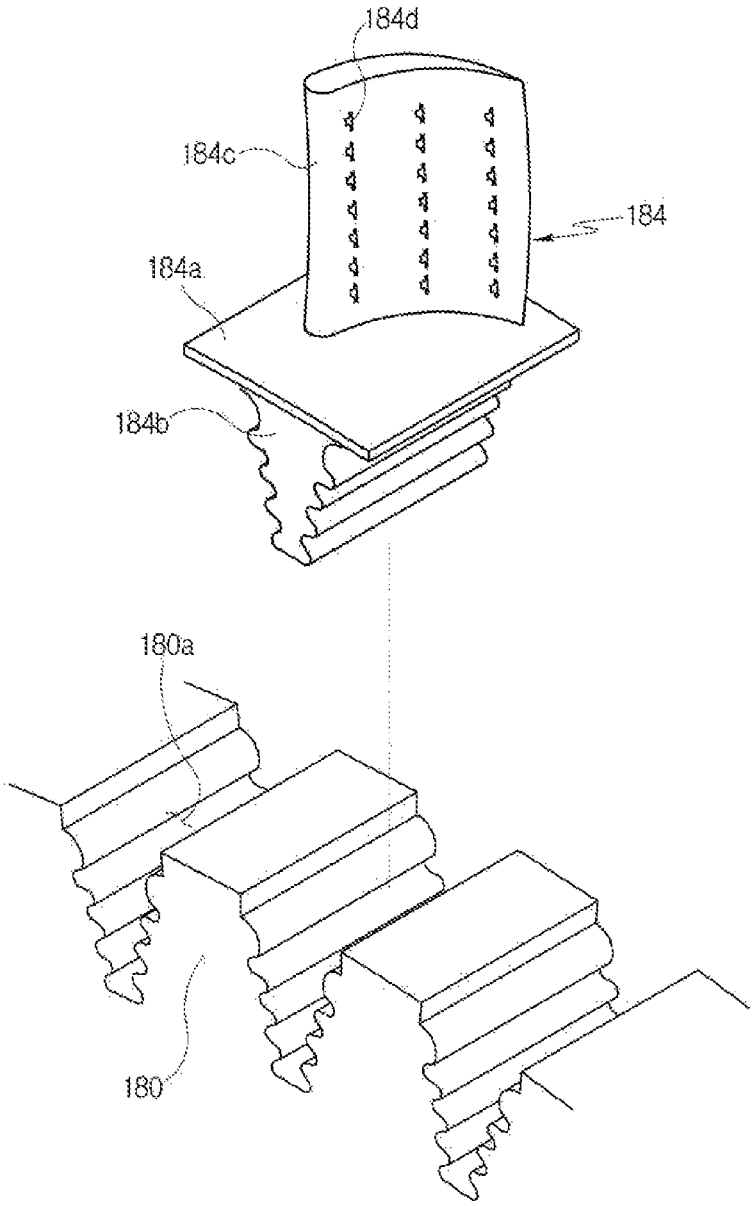
FIG. 2 is an exploded perspective view of a turbine rotor disk of the gas turbine of FIG. 1.

FIG. 2 illustrates the turbine rotor disk in the gas turbine of FIG. 1.

Referring to FIG. 2, the turbine rotor disk 180 has a substantially disk shape, and a plurality of coupling slots 180*a* is formed in an outer circumferential portion thereof. The coupling slot 180*a* has a curved surface in the form of a dovetail or fir-tree in an embodiment. FIG. 2 illustrates an exemplary embodiment in which the coupling slot 180*a* is provided with the fir-tree type curved surface.

The turbine blade 184 is fastened to the coupling slot 180*a*. In FIG. 2, the turbine blade 184 has a planar platform part 184*a* at approximately the center thereof. The platform parts 184*a* of the neighboring turbine blades abut against each other at lateral sides thereof, thereby serving to maintain the gap between the neighboring blades. A root part 184*b* is formed on the bottom surface of the platform part 184*a*. The root part 184*b* is inserted into the coupling slot 180*a* of the rotor disk 180, wherein the root part 184*b* has a substantially fir-shaped curved surface, which is formed to correspond to the shape of the curved surface of the coupling slot 180*a*. FIG. 2 illustrates a so-called axial-type root part 184*b*, which is inserted along the axial direction of the rotor disk 180.

A blade part 184*c* is formed on an upper surface of the platform part 184*a*. The blade part 184*c* is formed to have an airfoil optimized according to the specification of the gas turbine and has a leading edge disposed on the upstream side and a trailing edge disposed on the downstream side with respect to the flow direction of the combustion gas.

Here, unlike the blades of the compressor section, the blades of the turbine section come into direct contact with the high-temperature and high-pressure combustion gas. Since the temperature of the combustion gas is as high as 1,700° C., a cooling means is required for the blades of the turbine section. For this purpose, cooling paths are provided at some positions of the compressor section to additionally supply compressed air towards the blades of the turbine section.

The cooling path may extend outside the housing (external path), extend through the interior of the rotor disk (internal path), or both the external and internal paths may be used. In FIG. 2, a plurality of film cooling holes 184*d* is formed on the surface of the blade part. The film cooling holes 184*d* communicate with a cooling path (not shown) formed inside the blade part 184*c* so as to supply cooling air to the surface of the blade part 184*c*, thereby performing film cooling.

Hereinafter, a sealing structure between the turbine rotor disk 180 and the interstage disk 220 will be described in detail with reference to FIGS. 3 to 11.

Figure 3:
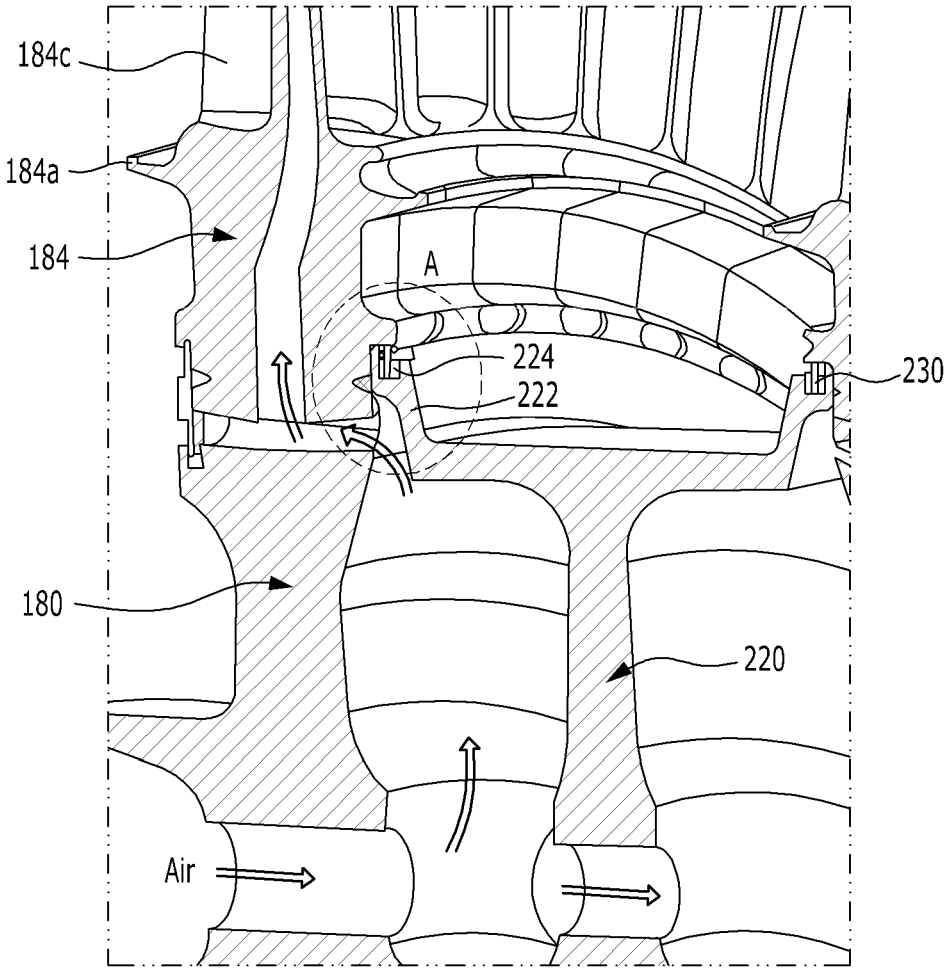
FIG. 3 is a view illustrating the overall configuration of a sealing structure between a turbine rotor disk and an interstage disk.
Figure 4:
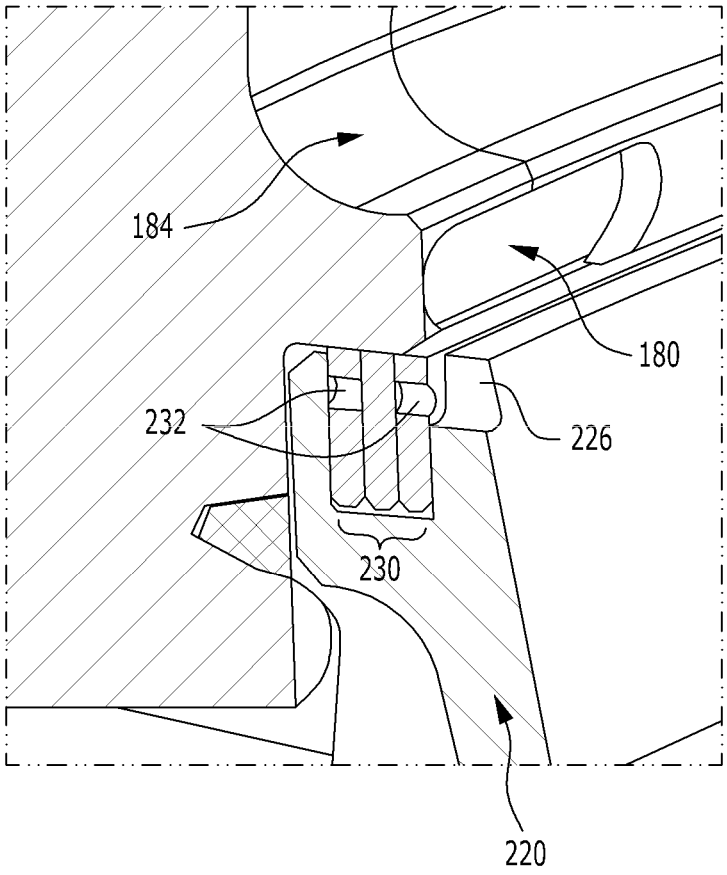
FIG. 4 is an enlarged view of part "A" of FIG. 3.
Figure 5:
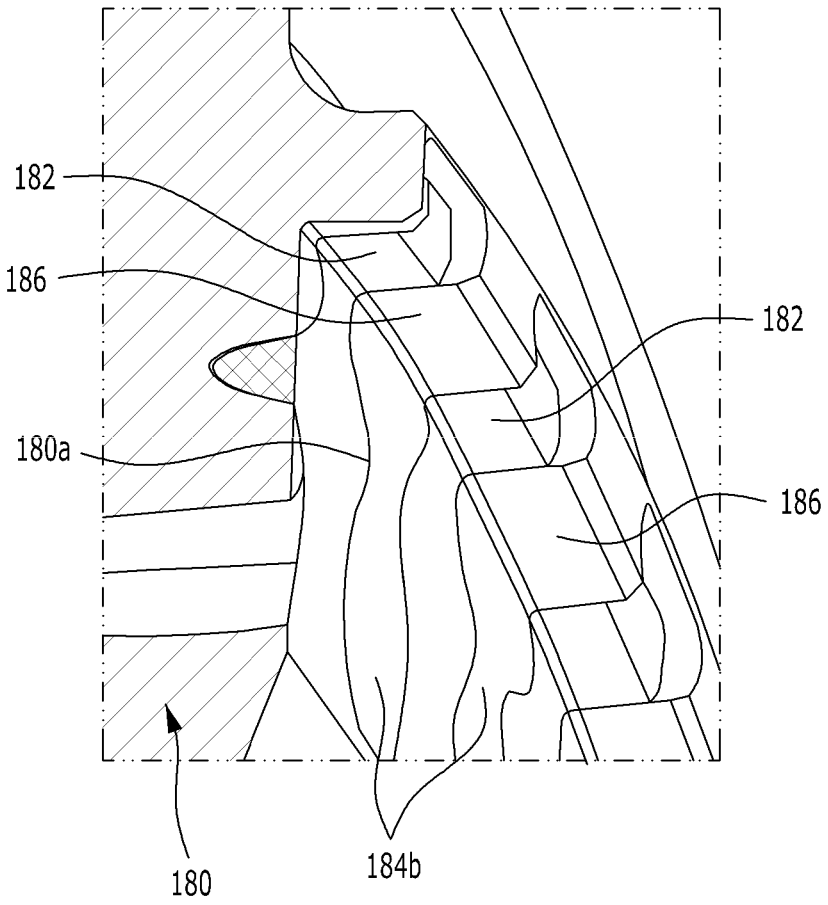
FIG. 5 is a view illustrating a structure in which a turbine blade is fastened to a turbine rotor disk.

FIGS. 3 and 4 illustrate the configuration of the sealing structure between the turbine rotor disk 180 and the interstage disk 220. FIG. 5 illustrates a structure in which the turbine blade 184 is fastened to the turbine rotor disk 180.

The sealing structure between the turbine rotor disk 180 and the interstage disk 220 according to the present disclosure includes a configuration associated with a turbine rotor disk 180, a turbine blade 184, an interstage disk 220, and a plurality of static ring seals 230.

The turbine rotor disk 180 is formed with a plurality of coupling slots 180*a* having curved surfaces along the circumferential surface thereof. The turbine blade 184 is fastened to the coupling slot 180*a* of the turbine rotor disk 180 along the axial direction (axial type). For this, refer to the description with respect to FIG. 2.

The turbine blade 184, as already described before, includes the root part 184*b* having a shape corresponding to the coupling slot 180*a* of the turbine rotor disk 180, the platform part 184*a* located radially outward from the root part 184*b*, and the blade part 184*c* extending from the platform part 184*a*.

The interstage disk 220 is interposed between the turbine rotor disks 180 to separate the turbine rotor disks 180 by an appropriate interval to form a space for the turbine vanes (see FIG. 1). In addition, the interstage disk 220 is provided with a rim portion 222 extending radially outward, with a groove 224 formed in the rim portion to mount a plurality of static ring seals 230 therein.

Referring to FIG. 3, a space in which cooling air supplied as internal bleeding flows is formed inside and between the turbine rotor disk 180 and the interstage disk 220. The cooling air enters a cavity inside the turbine blade 184 and cools inner and outer surfaces of the turbine blade 184, which was heated to a high temperature, in a collision cooling or film cooling manner. If there is a gap between the turbine rotor disk 180 and the interstage disk 220 during flowing of cooling air, cooling fluid is discharged through the gap, thereby lowering the cooling efficiency as well as lowering the temperature of the combustion gas, resulting in adversely affect on aerodynamic performance. For this reason, an appropriate sealing structure is required between the turbine rotor disk 180 and the interstage disk 220.

In order to provide an appropriate sealing structure for the turbine rotor disk 180 being rotated, it is required to provide a cylindrical contact surface with which the static ring seal 230 mounted on the rim portion 222 of the interstage disk 220 can be brought into stable contact. To this end, the turbine blade 184 is provided with a blade circumferential surface 186 protruding along an axial direction from a radially inner side of the platform part 184*a*, and the turbine rotor disk 180 has a corresponding disk circumferential surface 182 formed to protrude the along the circumferential direction to connect to the blade circumferential surface 186.

The blade circumferential surface 186 and the disk circumferential surface 182 arranged alternately along the circumferential direction form a smoothly connected circular curved surface, and the plurality of static ring seals 230 mounted in the groove 224 of the interstage disk 220 contact the rotating blade circumferential surface 186 and the disk circumferential surface 182 to perform a sealing action therebetween.

Figure 7:
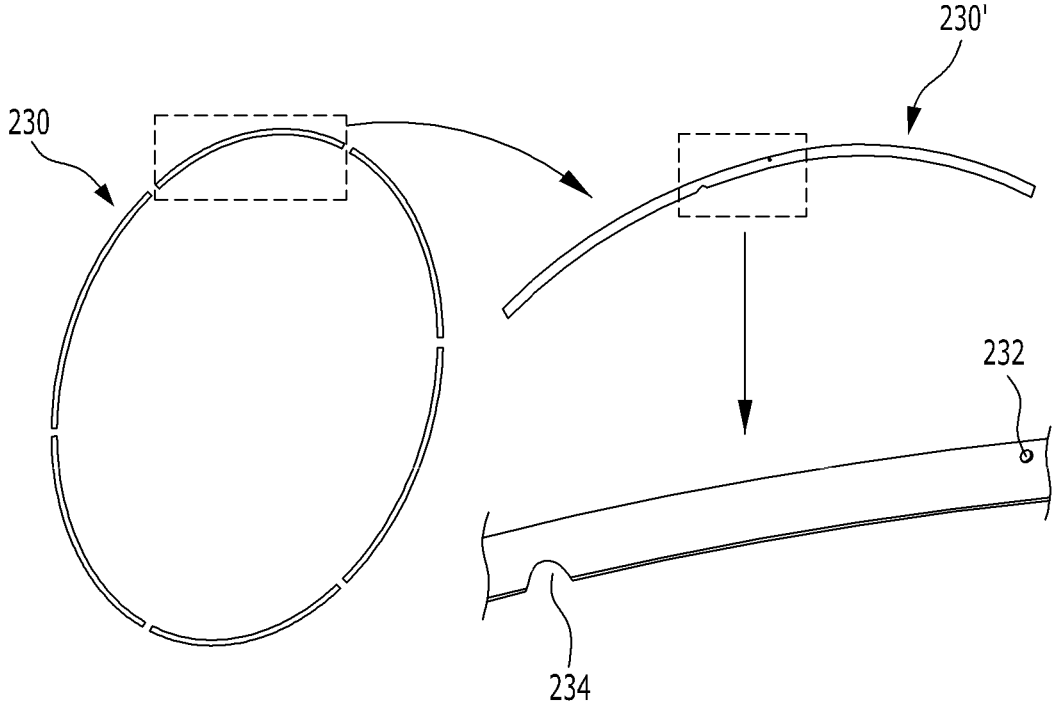
FIG. 7 is a view illustrating a static ring seal formed from a plurality of ring segments.

FIG. 7 illustrates one static ring seal 230, which is composed of a plurality of ring segments 230'. This configuration is obtained from the following reasons. Since the static ring seal 230 is used in a high temperature environment, the static ring seal is formed of a heat-resistant metal or ceramic, or a composite material thereof and thus has low elasticity. Thus, it is very difficult to mount one-piece circular static ring seal 230 in the groove 224 of the interstage disk 220 unless the groove has a special structure. Further, a further reason is because it is not easy to integrally form the static ring seal 230 having a large diameter.

Figure 9:
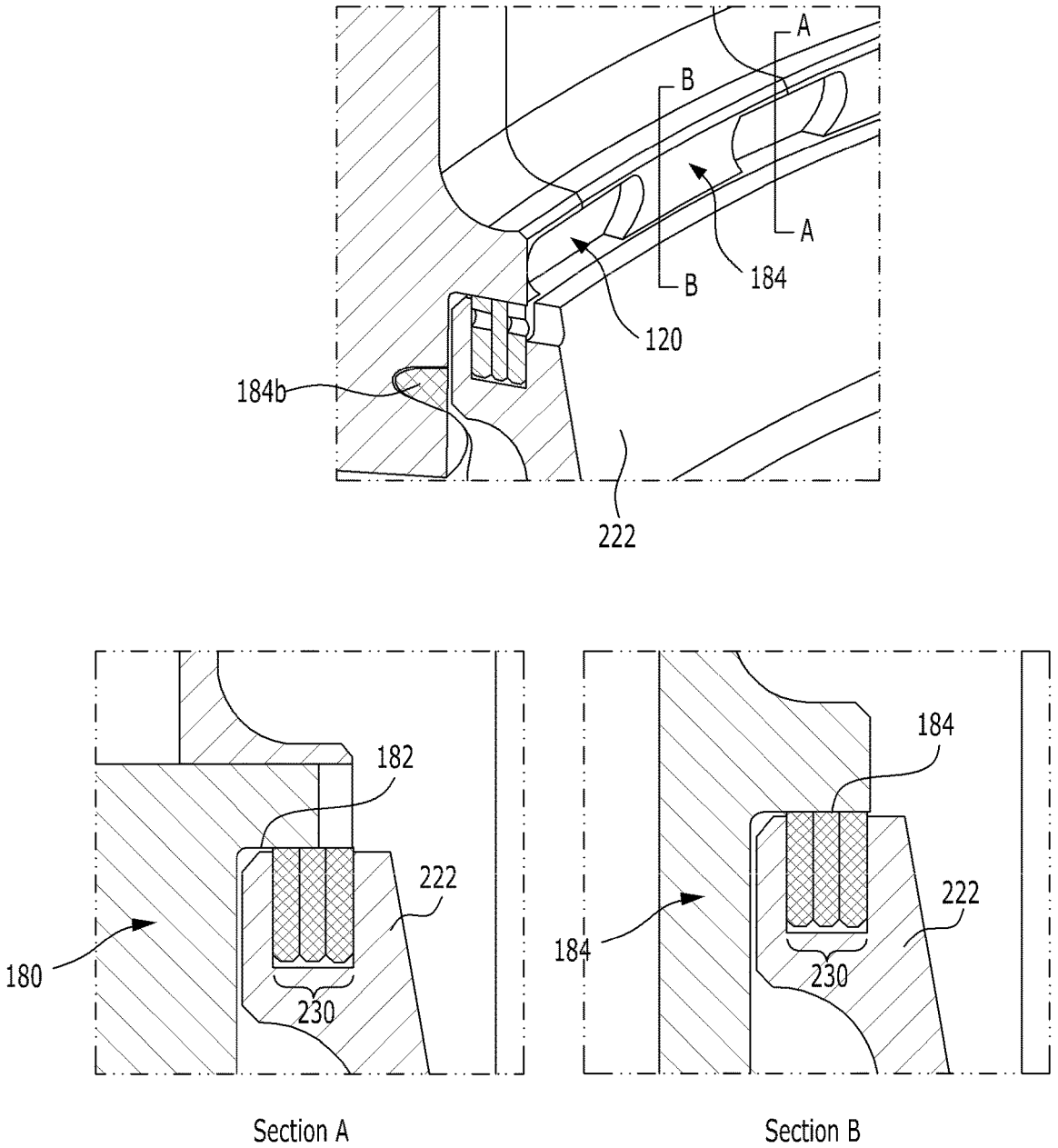
FIG. 9 is a cross-sectional view illustrating a sealing structure between a turbine rotor disk and an interstage disk.
Figure 10:
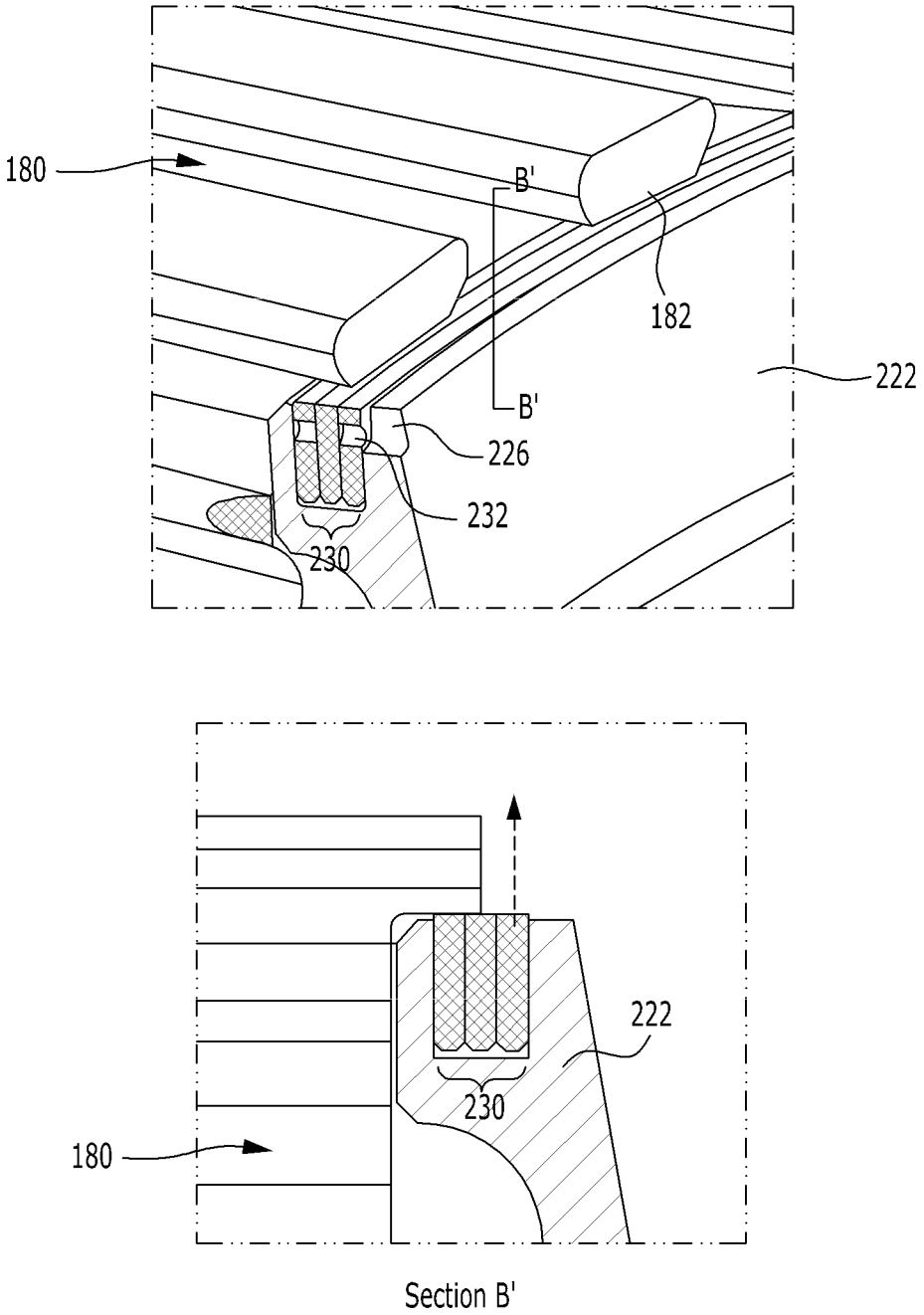
FIG. 10 is a view illustrating a state when the turbine blade is removed in FIG. 9.

The present disclosure focuses on the fact that the static ring seal 230 is made up of a plurality of ring segments 230, thereby allowing the static ring seal 230 to be replaced without separating the turbine rotor disk 180 and the interstage disk 220. This will be described in detail with reference to FIGS. 4 and 5, and FIGS. 9 and 10. FIG. 9 illustrates a sealing structure between the turbine rotor disk 180 and the interstage disk 220, and FIG. 10 illustrates a state when the turbine blade 184 is removed in FIG. 9.

Referring to FIG. 9, it can be seen that the blade circumferential surface 186 and the disk circumferential surface 182 have different areas in contact with the plurality of static ring seals 230. That is, looking at the "section A" across the disk circumferential surface 182 in FIG. 9, the disk circumferential surface 182 does not contact the outermost static ring seal 230 (e.g., the rightmost static ring seal in the drawing) among the static ring seals 230 with respect to the turbine blade 184. In contrast, looking at "section B" across the blade circumferential surface 186, the blade circumferential surface 186 is in contact with all of the plurality of static ring seals 230.

In other words, the axial extension length of the blade circumferential surface 186 is longer than the extension length of the disk circumferential surface 182 by a thickness of approximately one static ring seal 230. In FIG. 5, the structure in which the blade circumferential surface 186 is more protruding than the disk circumferential surface 182 is best illustrated.

In this way, allowing the disk circumferential surface 182 not to contact the outermost static ring seal 230 is for allowing the static ring seal 230 to be separated radially through a space corresponding to the thickness of the outermost static ring seal. FIG. 10 shows a state (section B') when the turbine blade 184 is separated in FIG. 9, wherein by allowing the contact with respect to all the static ring seals 230, the blade circumferential surface 186, which was suppressing the separation of the static ring seals (particularly the outermost static ring seal) in an operation state in which centrifugal force acts, loses the suppressing force by removing the turbine blade 184 along the axial direction. In other words, by removing the turbine blade 184 from the turbine rotor disk 180, a space is provided to extract the static ring seal 230 in the radial direction, which is an important technical feature of the present disclosure.

Compared to separating the turbine rotor disk 180 and the interstage disk 220 fastened by the tie rod 150, it is much easier to remove the individual turbine blades 184 from the turbine rotor disk 180 one by one. In addition, when the turbine rotor disk 180 and the interstage disk 220 are separated, the total amount of work, such as precise alignment after re-installation, is incomparably large, so it is very advantageous to separate the turbine blade 184 from the turbine rotor disk 180 in all aspects. This is another advantage of the present disclosure.

In the illustrated drawing, the disk circumferential surface 182 is shorter than the blade circumferential surface 186 by about the thickness of one static ring seal 230 so as not to contact the outermost one of the static ring seals 230. It is also possible to make the disk circumferential surface shorter by the thickness of two or more static ring seals 230 in terms of securing a space for separating the static ring seal 230. However, since the disk circumferential surface 182 also forms a sealing surface with respect to the static ring seal 230, in the illustrated embodiment, the shortened length of the disk circumferential surface is limited to the thickness of one static ring seal 230 in that it is more advantageous in terms of sealing performance to maintain the maximum contact area. For reference, referring to the drawings, the width for removing the static ring seal 230 is slightly larger than the thickness of one static ring seal 230, which gives a little margin in consideration of interference when removing the static ring seal 230.

It is convenient to form the plurality of static ring seals 230 to have the same thickness so that they can be used in common for maintenance and management, and in this case, all ring segments 230' have the same thickness, having an advantage in work efficiency since there is no need to care about the order of mounting the static ring seals 230 through the gap previously formed in the disk circumferential surface 182.

Figure 8:
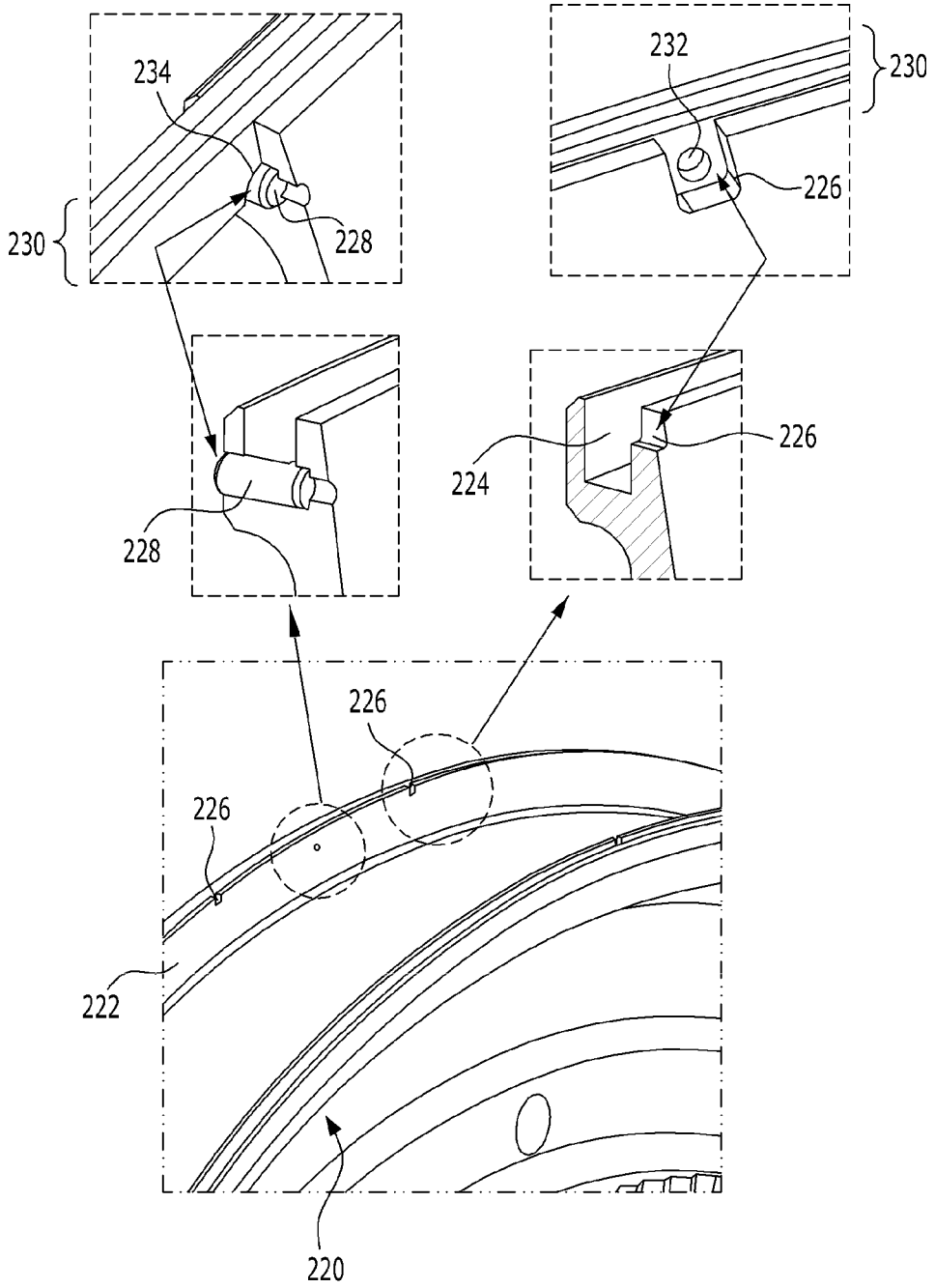
FIG. 8 is a view illustrating a structure in which a ring segment having a hole for separation and a slot for preventing rotation is mounted in a groove of an interstage disk.

FIG. 7 illustrates a static ring seal 230 formed from a plurality of ring segments 230', and FIG. 8 illustrates a structure in which a ring segment 230' having a hole 232 for separation and a slot for preventing rotation is mounted in a groove 224 of an interstage disk 220, which illustrates the inherent configuration of the present invention that makes it easy to replace (separate and mount) the static ring seal 230.

FIG. 7 illustrates an exemplary embodiment of a static ring seal 230 made up of six ring segments 230'. Referring to the partial enlarged view, individual ring segment 230' is provided with the separation hole 232 formed adjacent to a radially outer edge, and a semi-circular anti-rotation slot 234 formed along a radially inner edge.

Correspondingly, the interstage disk 220 is provided with a separation slot 226 formed to expose the separation hole 232 of each ring segment 230' along a radially outer edge of the rim portion 222, and an anti-rotation pin 228 formed in the groove 224 of the rim portion 222 so that the anti-rotation slot 234 of each ring segment 230' is fitted around the anti-rotation pin.

The separation hole 232 of the ring segment 230' and the separation slot 226 of the rim portion 222 are provided such that they can be easily separated along the radial direction by using the static ring seal 230 as a ring segment 230' unit. That is, the ring segment 230' can be easily removed by inserting a tool into the separation hole 232 through the separation slot 226 and applying a force in the radial direction. Therefore, the separation slot 226 of the rim portion 222 is provided with a cutout of the radially outer edge of the rim portion 222, and correspondingly, the separation hole 232 of the ring segment 230' is formed adjacent to the radially outer edge.

The anti-rotation slot 234 formed by cutting the radially inner edge of each ring segment 230' and the anti-rotation pin 228 provided in the groove 224 serve two functions. One function is to suppress the rotation of the ring segment 230' in the groove 224, as the term implies. When overlapping multiple pieces of static ring seals 230 divided into the ring segments 230' in the axial direction, preferably, the static ring seals 230 overlapping up and down are staggered such that the circumferences of the ring segments 230' do not match with each other, thereby reducing an outflow of cooling air through the gaps between the ring segments 230'. However, since the static ring seal 230 mounted in the groove 224 is in contact with the rotating blade circumferential surface 186 and the disk circumferential surface 182 so that the static ring seal is subjected to the force to rotate together with the circumferential surfaces, an anti-rotation structure is required to maintain the alignment. The rotation of each ring segment 230' is suppressed by the rotation prevention slot 234 of the ring segment 230' being engaged with the anti-rotation pin 228.

In another function of the anti-rotation slot 234 and the anti-rotation pin 228, when the static ring seal 230 is replaced, it is difficult to check the alignment of the static ring seal 230 because the removal and insertion operation is performed in a radial direction through a narrow gap. In particular, according to the present disclosure, since the static ring seal 230 is replaced without separating the turbine rotor disk 180 and the interstage disk 220, it is more difficult to visually check the operation. In this case, since the anti-rotation pin 228 provided in the groove 224 acts as a reference point for the alignment of the ring segment 230', correct alignment is conveniently ensured between the anti-rotation slot 234 of the ring segment 230' and the anti-rotation pin 228 through simple engagement of the anti-rotation slot 234 of the ring segment 230' with the anti-rotation pin 228 without a visual check.

Further, when the plurality of static ring seals 230 are mounted so as to be crossed with other adjacent ring segments 230' along the axial direction, at least two separation slots 226 are preferably staggered from each other such that the separation holes 232 of ring segments 230' are respectively exposed. This is because when the separation holes 232 of the vertically adjacent ring segments 230' form one through hole, a path through which cooling air is discharged is formed.

On the other hand, even when mounted to be staggered with other ring segments 230' adjacent to each other along the axial direction, the anti-rotation slot 234 of each ring segment 230' is preferably provided at positions (at different positions by staggered angle) where it is fitted around the anti-rotation pin 228 provided in the groove 224. This is because the anti-rotation pin 228 is a reference point for the alignment of the ring segment 230', so that it is undesirable to assign two or more anti-rotation pins 228 to one ring segment 230'.

On the other hand, FIG. 3 illustrates the turbine rotor disk 180 and the interstage disk 220 constituting the first stage of the turbine. Since the rim portion 222 of the interstage disk 220 extends in opposite directions toward both adjacent the turbine rotor disks, and the blade circumferential surface 186 and the disk circumferential surface 182 are formed on the side facing the interstage disk 220, the blade circumferential surface 186 and the disk circumferential surface 182 are not formed on the left side of the turbine rotor disk 180 constituting the first stage in the drawing. Therefore, although not shown in the drawings, it will be naturally appreciated that the turbine rotor disk 180 of the intermediate stage except for the turbine rotor disk 180 of the first stage and the final stage is configured such that the blade circumferential surface 186 and the disk circumferential surface 182 are respectively formed in both axial directions.

The present disclosure takes special account of the formation location of the blade circumferential surface 185 to reduce the cooling air leakage through the gap between the turbine blade 184 and the turbine rotor disk 180, and further to mitigate the stress applied to the static ring seal 230. This will be described with reference to FIGS. 5 and 6, in which FIG. 5 illustrates a structure in which the turbine blade 184 is fastened to the turbine rotor disk 180 and FIG. 6 illustrates the blade circumferential surface 186 formed to protrude from the turbine blade 184.

Figure 6:
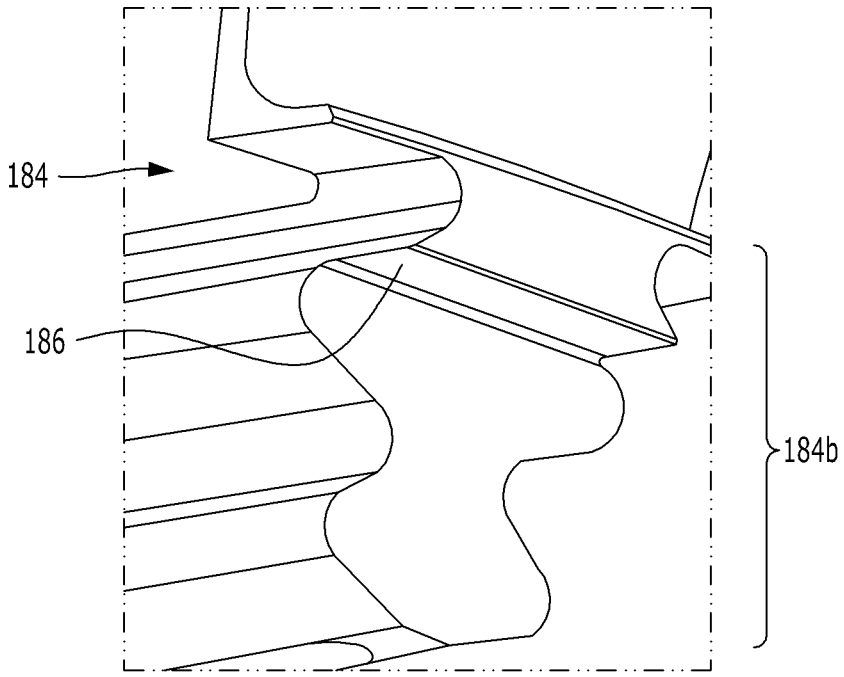
FIG. 6 is a view illustrating a blade circumferential surface formed to protrude from a turbine blade.

Referring to FIGS. 5 and 6, the blade circumferential surface 186 is formed such that a portion of the radially outer portion of the root part 184*b* of the turbine blade 184 is formed to protrude along the axial direction. Accordingly, the disk circumferential surface 182 extending continuously from the blade circumferential surface 186 as one circumferential surface also protrudes across the coupling slot 180*a*.

In addition, curved surfaces of the root part 184*b* are formed on both circumferential sides of the blade circumferential surface 186 protruding in the axial direction, and curved surfaces corresponding to those of the blade circumferential surface 186 are formed on the disk circumferential surface 182 of the turbine rotor disk 180 such that curved surfaces of the blade circumferential surface and the disk circumferential surface are mutually engaged with each other.

In the illustrated embodiment, the root part 184*b* of the turbine blade 184 and the coupling portion 180*a* of the turbine rotor disk 180 have a fir-tree-shaped curved surface, and the blade circumferential surface 186 and the disk circumferential surface 182 is tightly coupled to each other while constituting a part of the fir-shaped curved surface, there is almost no gap between the blade circumferential surface 186 and the disk circumferential surface 182.

This has the advantage of significantly reducing the risk of cooling gas leaking into this gap, compared to the case of forming a slight gap between the blade circumferential surface 186 and the disk circumferential surface 182 in consideration of the conventional assembly and thermal expansion. In addition, since it is only necessary to extend the rim portion 222 of the interstage disc 220 up to the upper portion of the root part 184*b* of the turbine blade 184, this leads to a result of reducing the diameter of the interstage disk 220. Accordingly, this also leads to a reduction in the diameter of the static ring seal 230, thereby mitigating the stress applied to the static ring seal 230.

Figure 11A:
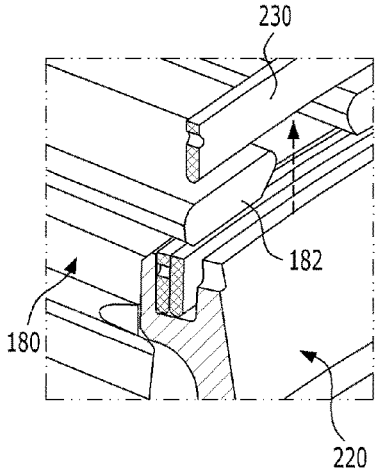
FIGS. 11A-11C are views respectively illustrating a process of sequentially separating a plurality of static ring seals in the state of FIG. 9.
Figure 11B:
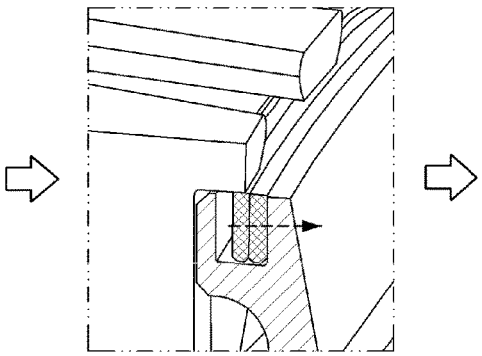
Figure 11C:
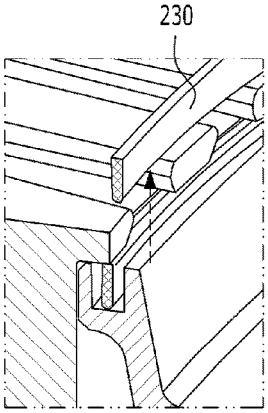

FIGS. 11A-11C illustrates a partial process of sequentially replacing a plurality of static ring seals 230 in the sealing structure between the turbine rotor disk 180 and the interstage disk 220 as described above.

In the sealing structure between the turbine rotor disk 180 and the interstage disk 220 according to the present disclosure, when the turbine blade 184 is separated along the axial direction from the turbine rotor disk 180, at least one of the plurality of static ring seals 230, which is disposed on the outermost side with respect to the turbine blade 184, is completely exposed with respect to the disk circumferential surface 182 (see FIG. 10). Therefore, one static ring seal 230 disposed on the outermost side can be separated along the radial direction as a unit of the ring segment 230' (FIG. 11A).

As the outermost one of the static ring seals 230 is separated, it is possible to access the other static ring seals 230, so the second static ring seal 230 may also be removed in the radial direction as a unit of ring segment 230' after being exposed with respect to the disk circumferential surface 182 (FIGS. 11B and 11C). All the static ring seals 230 can be removed by performing this process sequentially.

As described above, the present disclosure can remove all of the static ring seals 230 mounted on the interstage disk 220 without removing the turbine rotor disk 180 and the interstage disk 220 only through the removal of the turbine blade 184. Also, it is possible to completely replace the static ring seals 230 by sequentially mounting new static ring seals 230 in the reverse order of the separation process and refastening the turbine blade 184 along the axial direction with respect to the turbine rotor disk 180.

As described above, the separation and mounting of the static ring seals 230 can be easily performed by using the separation slot 226 formed along the radially outer edge of the rim portion 222 and the separation hole 232 formed in each ring segment 230'. Since the anti-rotation pin 228 provided in the groove 224 acts as a reference point for the alignment of the ring segment 230', correct alignment is conveniently ensured between the anti-rotation slot 234 of the ring segment 230' and the anti-rotation pin 228 through simple engagement of the anti-rotation slot 234 of the ring segment 230' with the anti-rotation pin 228 without a visual check.

While exemplary embodiments of the present disclosure have been described, those skilled in the art may diversely modify and change the disclosed invention without departing from the spirit of the present disclosure. Therefore, the embodiments disclosed in the present disclosure are not intended to limit the technical spirit of the present disclosure, but to illustrate the present disclosure, and the scope of the technical spirit of the present disclosure is not limited to these embodiments.

What is claimed is:

1. A sealing structure for a gas turbine including a plurality of turbine rotor disks, the sealing structure comprising:

a turbine rotor disk of the plurality turbine rotor disks;

a turbine blade fastened to a coupling slot formed in a circumferential surface of the turbine rotor disk, the turbine blade including a root having a shape corresponding to the coupling slot, a platform positioned radially outward from the root, a blade extending from the platform, and a blade circumferential surface that is formed on a radially inner side of the platform and protrudes in an axial direction, the blade circumferential surface extending in a circumferential direction of the turbine rotor disk and mutually engaging with a disk circumferential surface formed circumferentially on the turbine rotor disk;

an interstage disk interposed between adjacent turbine rotor disks of the plurality of turbine rotor disks, the interstage disk including a rim portion extending radially outward and a groove formed in the rim portion; and a plurality of static ring seals mounted in the groove of the interstage disk, each static ring seal having an outer circumferential surface facing toward the blade circumferential surface and the disk circumferential surface, the plurality of static ring seals configured such that the outer circumferential surface of all of the plurality of static ring seals contact the blade circumferential surface and such that the outer circumferential surface of at least one of the plurality of static ring seals does not contact the disk circumferential surface.

2. The sealing structure according to claim 1, wherein the plurality of static ring seals are arranged in the axial direction from the turbine blade and include an outermost static ring seal with respect to the turbine blade, and wherein the at least one of the plurality of static ring seals that does not contact the disk circumferential surface includes the outermost static ring seal.

3. The sealing structure according to claim 2, wherein each static ring seal consists of a plurality of ring segments.

4. The sealing structure according to claim 3, wherein each of the plurality of ring segments includes a separation hole, and wherein the rim portion of the interstage disk includes a radially outer edge in which a separation slot is formed and configured to expose the separation hole of a ring segment of the outermost static ring seal.

5. The sealing structure according to claim 4, wherein the plurality of ring segments of one of the plurality of static ring seals are mounted to be staggered in the axial direction with respect to the plurality of ring segments of an adjacent static ring seal of the plurality of static ring seals, and wherein the separation slots include at least two separation slots configured to expose the separating holes of the staggered ring segments.

6. The sealing structure according to claim 3, wherein each of the plurality of ring segments includes a radially inner edge in which an anti-rotation slot is formed, the anti-rotation slot receiving an anti-rotation pin provided in the groove.

7. The sealing structure according to claim 6, wherein the plurality of ring segments of one of the plurality of static ring seals are mounted to be staggered with respect to the plurality of ring segments of an adjacent static ring seal of the plurality of static ring seals, and wherein the anti-rotation slots of the plurality of ring segments are respectively formed at positions where the anti-rotation pin is received simultaneously by the anti-rotation slots of the plurality of ring segments.

8. The sealing structure according to claim 1, wherein the plurality of static ring seals are arranged in the axial direction from the turbine blade and include an outermost static ring seal with respect to the turbine blade, wherein each of the plurality of static ring seals has an equal thickness in the axial direction, and wherein the disk circumferential surface is not in contact with of the plurality of static ring seals, only the outermost static ring seal.

9. The sealing structure according to claim 1, wherein the rim portion of the interstage disk includes an opposing pair of rim portions respectively extending in opposite directions toward each of the adjacent turbine rotor disks, and wherein the blade circumferential surface and the disk circumferential surface are formed on opposite sides of the interstage disk.

10. The sealing structure according to claim 1, wherein the blade circumferential surface is formed such that a radially outer portion of the root protrudes in the axial direction.

11. The sealing structure according to claim 10, wherein the blade circumferential surface includes a curved surface respectively formed on axially opposite sides of the turbine blade.

12. The sealing structure according to claim 11, wherein the disk circumferential surface includes a curved surface respectively formed on axially opposite sides of the turbine rotor disk, and wherein the curved surface of the disk circumferential surface corresponds to the curved surface of the blade circumferential surface, such that the curved surfaces of the disk circumferential surface and the blade circumferential surface are mutually engaged with each other.

13. The sealing structure according to claim 1, wherein the plurality of ring segments of one of the plurality of static ring seals are mounted to be staggered in the axial direction with respect to the plurality of ring segments of an adjacent static ring seal of the plurality of static ring seals, wherein each of the staggered ring segments includes a separation hole and a radially inner edge in which an anti-rotation slot is formed, wherein the rim portion of the interstage disk includes a radially outer edge in which at least two separation slots are formed and configured to expose corresponding separation holes of the staggered ring segments, and wherein the groove is provided with a single anti-rotation pin configured to be simultaneously captured by the anti-rotation slots of the staggered ring segments.

* * * * *